US005435457A

United States Patent [19]

Tiner et al.

[11] Patent Number: 5,435,457

[45] Date of Patent: Jul. 25, 1995

[54] RACK COVER

[75] Inventors: Nathan A. Tiner, Laguna Beach; Daniel M. Kavanaugh, Long Beach, both of Calif.

[73] Assignees: Microprocess Laboratory, Inc.; Ano d'art, Inc., both of Huntington Beach, Calif.

[21] Appl. No.: 95,951

[22] Filed: Jul. 22, 1993

[51] Int. Cl.[6] ..... C25D 13/00

[52] U.S. Cl. ..... 220/485; 118/428; 118/500

[58] Field of Search ..... 220/485, 489, 493, 494, 220/495; 118/71, 428, 429, 500, 501, 503

[56] References Cited

U.S. PATENT DOCUMENTS

| | | | |
|---|---|---|---|
| 1,007,477 | 10/1911 | Moscrip, Jr. | 220/493 |
| 2,318,164 | 5/1943 | Kellems | 220/485 X |
| 2,387,300 | 10/1945 | Ronci | 220/485 X |
| 2,507,152 | 5/1950 | Garofalo | 220/485 X |
| 2,962,273 | 11/1960 | Moore | 220/495 X |
| 4,196,231 | 4/1980 | Hübers | 118/500 X |
| 4,755,273 | 7/1988 | Bassett et al. | 118/428 X |
| 4,812,211 | 3/1989 | Sakai | 220/485 X |

OTHER PUBLICATIONS

Westin Manufacturing Company (catalog), pp. 5 and 7, Chaska, Minn.

Dennison Bar-Lok Cable Tie (catalog), p. 3, Farmingham, Mass.

Fry Steel Company (catalog), p. 1.

Internet Incorporated (sales flyer), Minneapolis, Minn.

Finishers' Management (magazine), p. 51, May 1993, Glenview, Ill.

Metal Finishing (magazine), p. 96, Glenview, Ill.

Finisher's Management (magazine), p. 34, Aug. 1993, Glenview, Ill.

Burke Rack, Inc. (sales flyer), Brea, Calif.

Panduit Corp. (catalog), p. 3, Tinley Park, Ill.

Developments, p. 75, Jan. 1991.

*Primary Examiner*—Steven M. Pollard

*Attorney, Agent, or Firm*—Knobbe, Martens, Olson & Bear

[57] ABSTRACT

The present invention is an apparatus for recovering objects which fall from racks during the process of anodization. The apparatus includes a body, a base, a spacing member and a plurality of connectors. The body has an interior surface at least partially defining a space sized and shaped such that a rack loaded with objects to be anodized can be substantially contained within the space. The surface is electrically non-conductive so that it will not interfere with the anodization process. The base is connected to the body and is positioned below the space defined by the body for catching objects which fall from a rack positioned within the space. The base further defines openings through which liquid may pass. The spacing member is securable to the spine of the rack holding objects to be anodized. The plurality of connectors are secured to the spacing member such that the spacing member and the connectors cooperate to space the interior surface of the body from objects positioned on a rack substantially contained within the space, thereby preventing the body from touching the parts, causing defects during anodization.

4 Claims, 4 Drawing Sheets

RACK COVER

BACKGROUND OF THE INVENTION

The present invention relates generally to devices for preventing loss of objects which are electrochemically processed by immersion in tanks or vats.

Commercial processes such as anodizing or electroplating require the immersion of parts sequentially into a series of tanks or vats. The immersion process is accomplished by suspending the parts on a rack which holds the parts during the immersion processes. The parts so processed are attached to these racks and have a baseline rate of falling into the tanks or vats during the processes. Generally, the parts so processed are small and it is uneconomical to retrieve the fallen parts from the bottom of the tanks or vats after each processing step is completed.

Currently, flexible anode bags are used to prevent loss of components in anodizing. However, the bags are undesirable in that they can easily contact the workpieces during anodization and cause surface defects on the anodic films produced on the workpieces. Additionally, the bags are undesirable in that they are bulky and inconvenient to work with. Thus, there remains a need for a device that will allow the recovery of detached parts during anodizing, electroplating or similar processes which would otherwise fall into the tanks or vats.

SUMMARY OF THE INVENTION

The present invention is an apparatus for catching or retaining objects or parts which fall from racks during the process of anodization. The apparatus includes a body, a base, a spacing member and a plurality of connectors. The body has an interior surface at least partially defining a space sized and shaped such that a rack loaded with objects to be anodized can be substantially contained within the space. The surface is electrically non-conductive so that it will not interfere with the anodization process. The base is connected to the body and is positioned below the space defined by the body for catching objects which fall from a rack positioned within the space. The base further defines openings through which liquid may pass. The spacing member is securable to the spine of the rack holding the objects to be anodized. The plurality of connectors are secured to the spacing member such that the spacing member and the connectors cooperate to space the interior surface of the body from objects positioned on a rack substantially contained within the space, thereby preventing the body from touching the parts, which would otherwise cause defects during anodization.

Desirably, the base comprises a sheet of polypropylene netting, heat-pressed to form a bowl shape and having a periphery which is directly secured to the body, thereby assisting the body in maintaining its shape when subjected to load.

The apparatus further desirably includes a stiffening band secured to the periphery of the base to assist the base in maintaining its shape when subjected to load. Desirably, the stiffening band is also secured to the body so that the stiffening band assists the body in maintaining its shape when subjected to load.

Due to the volume of racks utilized in the anodization process, it is important that the apparatus be inexpensive. Advantageously, the apparatus is designed so as to be easily manufactured. Specifically, the body and the base are desirably manufactured from electrically non-conductive sheets of netting, such as polypropylene. Likewise, the spacing member desirably is formed from two elongated metal strips secured to one another, usually at the center, and positioned relative to one another to cooperate with the plurality of connectors to support the body from at least two and preferably four discrete points. Advantageously, supporting the body from such discrete points not only better maintains the spacing of the interior surface of the body from objects secured on the rack, but additionally, assists in maintaining the shape of the body, when the body is subjected to loads.

DETAILED DESCRIPTION OF THE INVENTION

Figure 1:
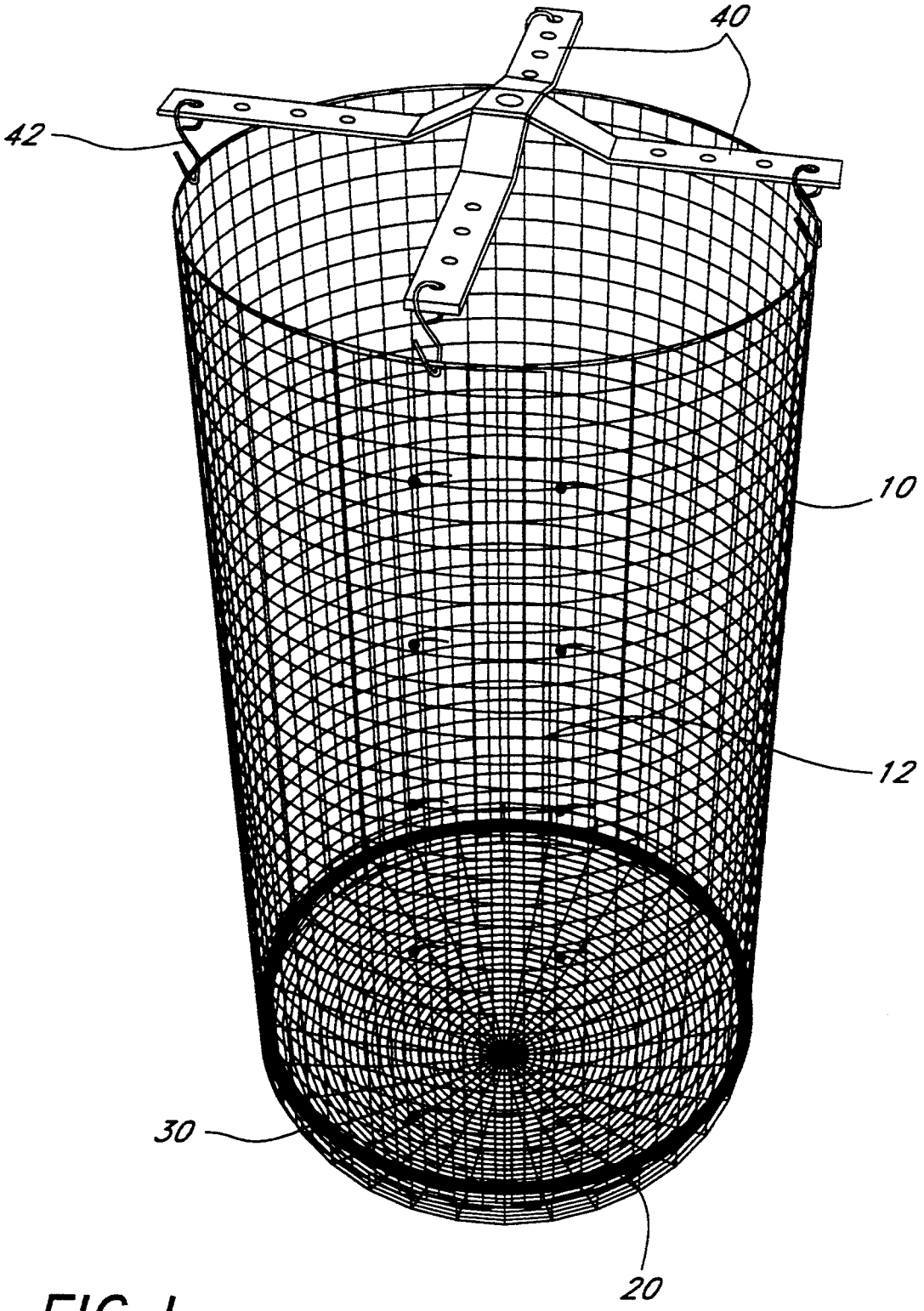
FIG. 1 is a perspective view of a preferred embodiment of the rack cover of the present invention.
Figure 2:
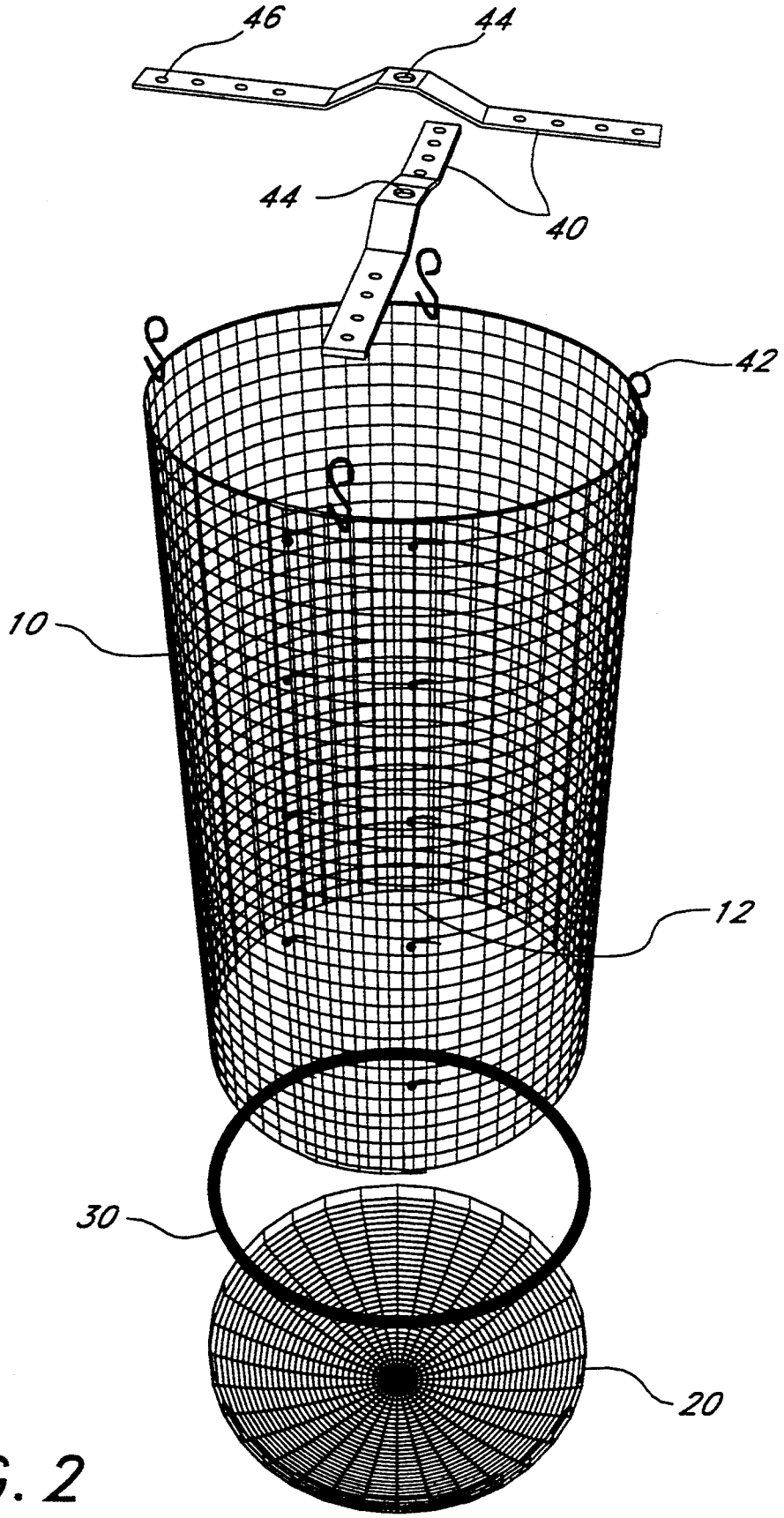
FIG. 2 is an exploded view of the rack cover of FIG. 1.

Referring to FIGS. 1 and 2, the rack cover is assembled from five main components: a body 10 is comprised of a sheet of netting material formed into a cylinder with an overlapping area 12; a base 20; a stiffening band ring 30; a support member or members 40; and a plurality of connectors or hooks 42.

All materials used in construction of the device must be able to withstand the conditions present in the tanks or vats. For example, in a typical commercial anodizing process, the material used for the body 10 can consist of a plastic net made of polypropylene. A suitable material for anodizing has been found to be polypropylene net supplied by InterNet © Inc. of 2730 Nevada Avenue N., Minneapolis, Minn. 55427 which has the characteristics of 0.9 grams/cm, density 5 ksi, tensile strength 200 ksi, modulus 66 psi, thermal deflection at 216° F., 310° F. softening point and $50\times10^{-6}$ in/in/F linear thermal coefficient of expansion. Characteristics of the net used in the preferred embodiment include an approximate open area of 49%, approximate hole size of 0.375 inches, spine and rib size of 0.04 inches$\times$0.080 inches, nominal thickness of 0.134 inches and a flat cut size of approximately 51 inches$\times$32 inches. The body 10 is formed by rolling the netting material into a cylinder. Desirably, the body 10 includes an interior surface defining a space at least 28 inches in height with a diameter of at least 12 inches. Preferably, the space has a height of approximately 32 inches and a minimum horizontal dimension, in this case a diameter, of approximately 15 inches. In the preferred embodiment, the cylinder formed is 32 inches high with approximately 4 inches of overlap. Other materials known to those skilled in the art may also be suitable including ABS small thermoplastic and other thermoplastic resins.

The base 20 is desirably composed of the same polypropylene net as the cylinder in the preferred embodiment. However, other suitable materials may be used. The disc is formed from a circular flat sheet of netting material, having a diameter of approximately 18-inches, which is placed in a hot press. The male dye is heated by resistance to approximately 210°-240° F. The male dye is then used to press the plastic net into the female dye for approximately 2–5 minutes by air pressure forming a bowl-shaped disc approximately 15 inches in diameter, the same diameter as the base of the cylinder.

The stiffening ring 30 is desirably formed from metal wire approximately ¼ inch thick which is butt-welded into a circular shape having approximately the same diameter as the bottom of the cylinder. The stiffening ring is attached to circumference of the formed base 20. The base assembly is then attached to the cylinder.

Attachments of the stiffening ring to the disc, the disc to the cylinder and closure of the cylinder from a flat sheet is accomplished using plastic ties. A suitable plastic tie is available from Dennison under the brand name BAR-LOC® cable tie. Commercially available plastic tie tightening tools are well known to those skilled in the art. One such tool is Model L-200 Tensioning Tool from Catamount Inc.

The spacing members 40 are desirably constructed from stainless steel or other suitable material. Desirably, the spacing members define a concave center portion. At the midpoint of the members, is a hole 44 to admit the rack spine used in the anodizing process. The distal ends of the members contain smaller holes 46 to allow hooks to connect the members to the top of the cylinder.

In the preferred embodiment, two such support strips cross over one another and are joined to the top of the cylinder with four connecting members 42, such as hooks. The hooks can be of the same material as the support strips or another suitable material. In the preferred embodiment, the hooks are stainless steel.

Figure 4:
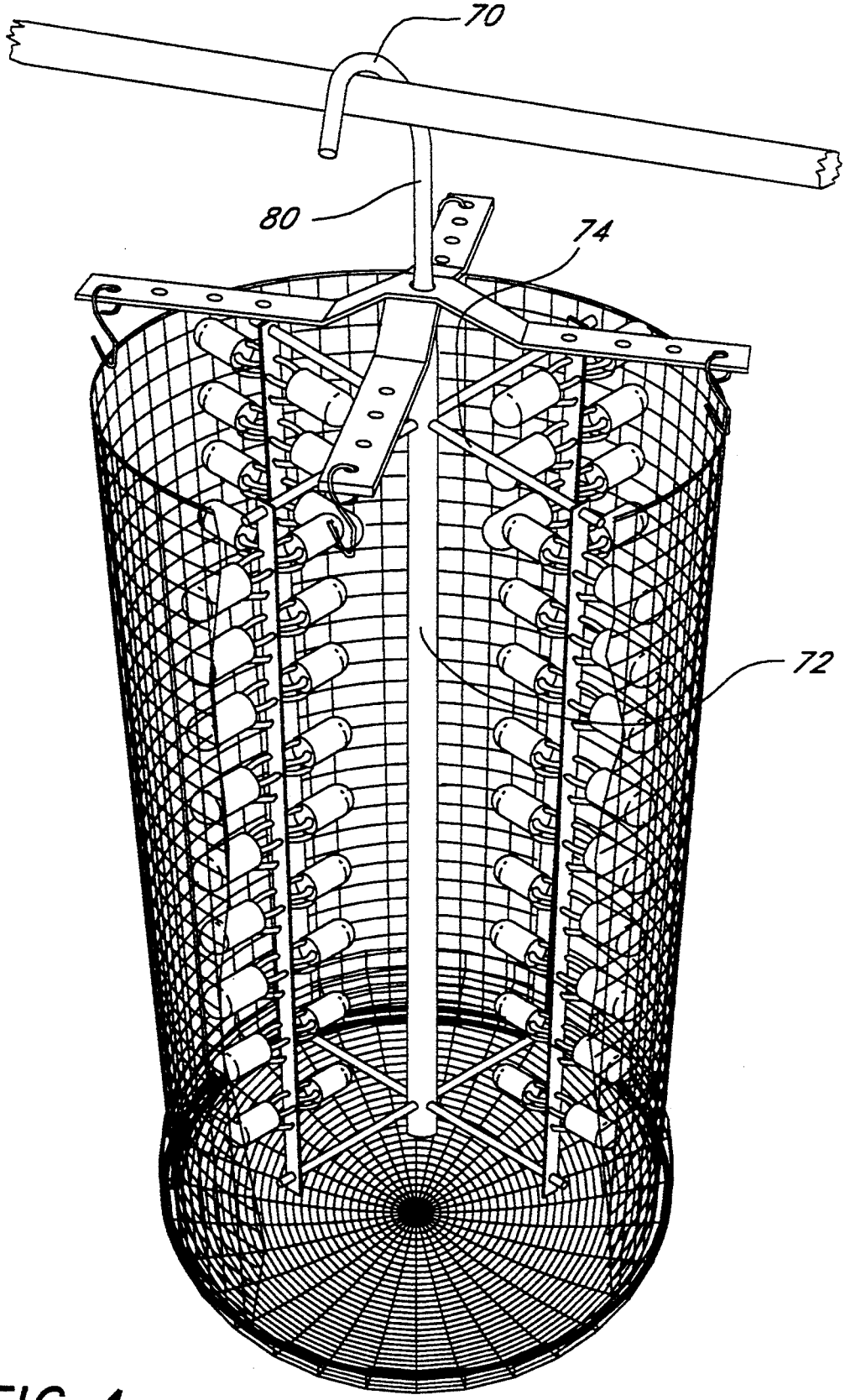
FIG. 4 is a perspective view illustrating the rack cover of FIG. 1 secured to a rack.

FIG. 4 shows a rack cover in use. The cover is placed over a spine 70 of a standard rack 80 commonly used commercially in a manufacturing process such as anodizing or electroplating. Suitable racks include those made by Westin Manufacturing Company, Jonathan Industrial Center, Chaska, Minn. 55318 and Burk Rack. Typically, such a rack 70 would comprise a center shaft 72 with multiple rows of radially extending pins 74 spaced along the shaft at intervals corresponding to the size of the parts being processed. The device would then be immersed in the vat or tank along with the parts which are undergoing the anodizing process. As the parts are removed from the tanks or vats and re-immersed in other tanks and vats, the parts remain enclosed in the device. At the completion of the manufacturing process, any parts that would have otherwise fallen into the tanks or vats will be present at the bottom of the device. The device is then removed from the rack and the parts retrieved from the bottom of the device. It is anticipated that several devices will be used adjacent to one another so that all parts immersed into the tank or vat are enclosed.

Figure 3:
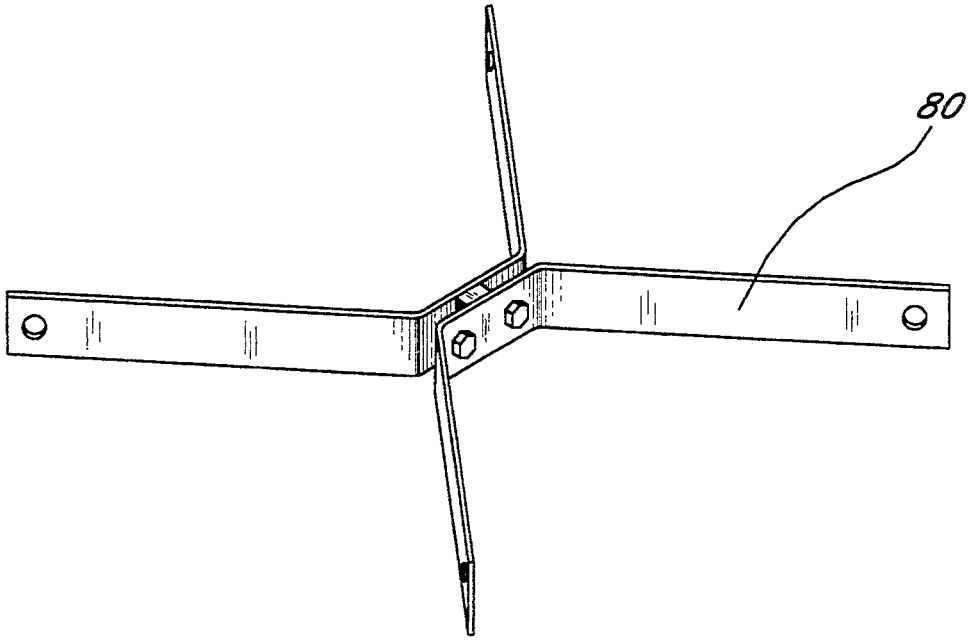
FIG. 3 is a perspective view of an alternative embodiment of a spacing member for the rack cover of FIG. 1.

Some commercial racks do include a flat spine, rather than a round spine. Accordingly, FIG. 3 illustrates an alternative spacing member 80 for use with such racks. The spacing member 80 is formed from two metal strips, each defining an included angle of approximately 120°, which are secured to one another.

The foregoing describes the preferred design of the invention and is believed to be superior to other designs due to cost, ease of manufacture and strength. However, other embodiments could include a device without the stiffening ring where the cylinder is made from a material with a suitable inherent stiffness. The net could also be preformed in one piece into a cylinder.

The advantages to the embodiment as described are that it is simple to construct, formed from readily available materials, inexpensive to produce and reusable for a considerable number of immersions and removals from the vats and tanks.

We claim:

1. An apparatus for anodizing, comprising:

a body having a central axis comprised of plastic netting having an interior surface at least partially defining a space sized and shaped such that a rack loaded with objects to be anodized can be substantially contained within said space, said body being electrically non-conductive and defining openings through which liquid may pass;

a base having a periphery comprised of plastic netting connected to said body positioned below said space for catching objects which fall from a rack positioned within said space, said base being electrically non-conductive and defining openings through which liquid may pass;

a metal stiffening band secured to said periphery of said base;

a rack for supporting objects to be anodized, said rack defining a central spine;

a spacing member defining one of an aperture sized and shaped to receive and retain said spine of said rack in alignment with said central axis of said body for supporting objects to be anodized and a clamp securable to said rack for supporting objects to be anodized; and a plurality of connectors secured to said spacing member such that said spacing member and said connectors cooperate with said body to space said interior surface of said body from objects positioned on a rack substantially contained within said space, thereby preventing said body from contacting the objects to be anodized and causing defects during anodization.

2. The apparatus of claim 1, wherein said stiffening band is likewise secured to said body so that said stiffening band assists said body in maintaining its shape when subjected to load.

3. The apparatus of claim 2, wherein said base is bowl-shaped to retain fallen objects.

4. The apparatus of claim 3, wherein said spacing member comprises two elongated metal strips secured to one another and positioned relative to one another to cooperate with said plurality of connectors to support said body from at least four discrete points.

* * * * *